United States Patent [19]

Baillie

[11] 4,399,989

[45] Aug. 23, 1983

[54] SAFE GRIP SLICER FOR BAGELS, ROLLS, MUFFINS AND THE LIKE

[76] Inventor: Robert A. Baillie, 20 Montana Dr., Jackson, N.J. 08527

[21] Appl. No.: 263,107

[22] Filed: May 13, 1981

[51] Int. Cl.[3] ..... B26D 7/02

[52] U.S. Cl. ..... 269/87.2; 269/236; 269/238; 269/295; 83/762

[58] Field of Search ..... 83/762, 763, 761, 454, 83/464, 467 R; 269/87.2, 238, 288, 295, 236

[56] References Cited

U.S. PATENT DOCUMENTS

| | | | |
|---|---|---|---|
| 528,968 | 11/1894 | Peabody | 269/236 X |
| 2,421,200 | 5/1947 | Hall | 269/236 X |
| 4,249,445 | 2/1981 | Browning | 83/762 |

*Primary Examiner*—Donald R. Schran

*Attorney, Agent, or Firm*—Charles I. Brodsky

[57] ABSTRACT

A fixture having a channel for accepting a user inserted knife blade, a first, floating plate for holding in place one surface of the bagel, roll or muffin to be sliced, and a second, rigid plate for bearing against the opposite surface of the bagel, roll or muffin, and positionally adjustable with respect to the channel for controlling the thickness of the resulting sliced sections.

9 Claims, 8 Drawing Figures

SAFE GRIP SLICER FOR BAGELS, ROLLS, MUFFINS AND THE LIKE

FIELD OF THE INVENTION

This invention relates to a fixture for controlling the slicing of bagels, rolls, muffins, and the like, and, in particular, to a fixture to ensure a slicing of sections of controllable thickness, and with a high degree of safety.

SUMMARY OF THE INVENTION

As will become clear hereinafter, the slicer of the invention includes a channel in which the user inserts the cutting blade of the knife employed. Rather than holding the bagel, roll or muffin to be sliced in the other hand, such item is inserted within the cavity of the device, adjacent the knife accepting channel. A handle is provided, which when manually activated moves a first, floating plate to abut one surface of the bagel, roll, muffin, etc., and to hold it in place against a second, rigid surface, which is positionally adjustable as regards the channel, so as to permit a degree of control over the thickness of the slice sections which result. Because one hand of the user is holding the handle of the knife blade in cutting the bagel, etc. in a "sawing" action, for example, and the other is holding the handle of the fixture to secure the placement of the item in the cavity, the likelihood of a person accidentally cutting their hand in slicing the bagel, roll or muffin is kept quite low. (This is to be contrasted with the most commonly employed method used today in cutting such items—namely, holding the bagel, roll, muffin in the palm of one hand, and using the other hand holding a knife to slice it—where the potential for injury is real and not an infrequent happening.) In accordance with a preferred embodiment of the invention, the second, rigid plate is reversible in orientation with regard to the knife blade channel, so as to permit slice sections to be of a first or second thickness. By making this second plate removable, furthermore, and providing the fixture with a bearing surface at a cavity wall, a third slice section thickness can be arranged. In a second embodiment of the invention, on the other hand, the rigid plate can be made continuously adjustable—towards and away from the channel opening—so as to provide a wide range of slice thicknesses. As will be seen below, not only is the fixture of the invention capable of providing a safe slicing of bagels, rolls, muffins, and the like, but can provide the additional, unique feature of enabling the construction of double-decker, triple-decker, etc. sandwiches—all with a high degree of simplicity, and by fabricating the first, floating plate to be integral with the slicer handle, can then yield a construction which can be operated by a user of limited strength, as by the aged and/or infirm.

BRIEF DESCRIPTION OF THE DRAWINGS

These and other features of the invention will be more clearly understood from a considering of the following description, taken in connection with the accompanying drawings in which.

DETAILED DESCRIPTION OF THE DRAWINGS

Figure 1:
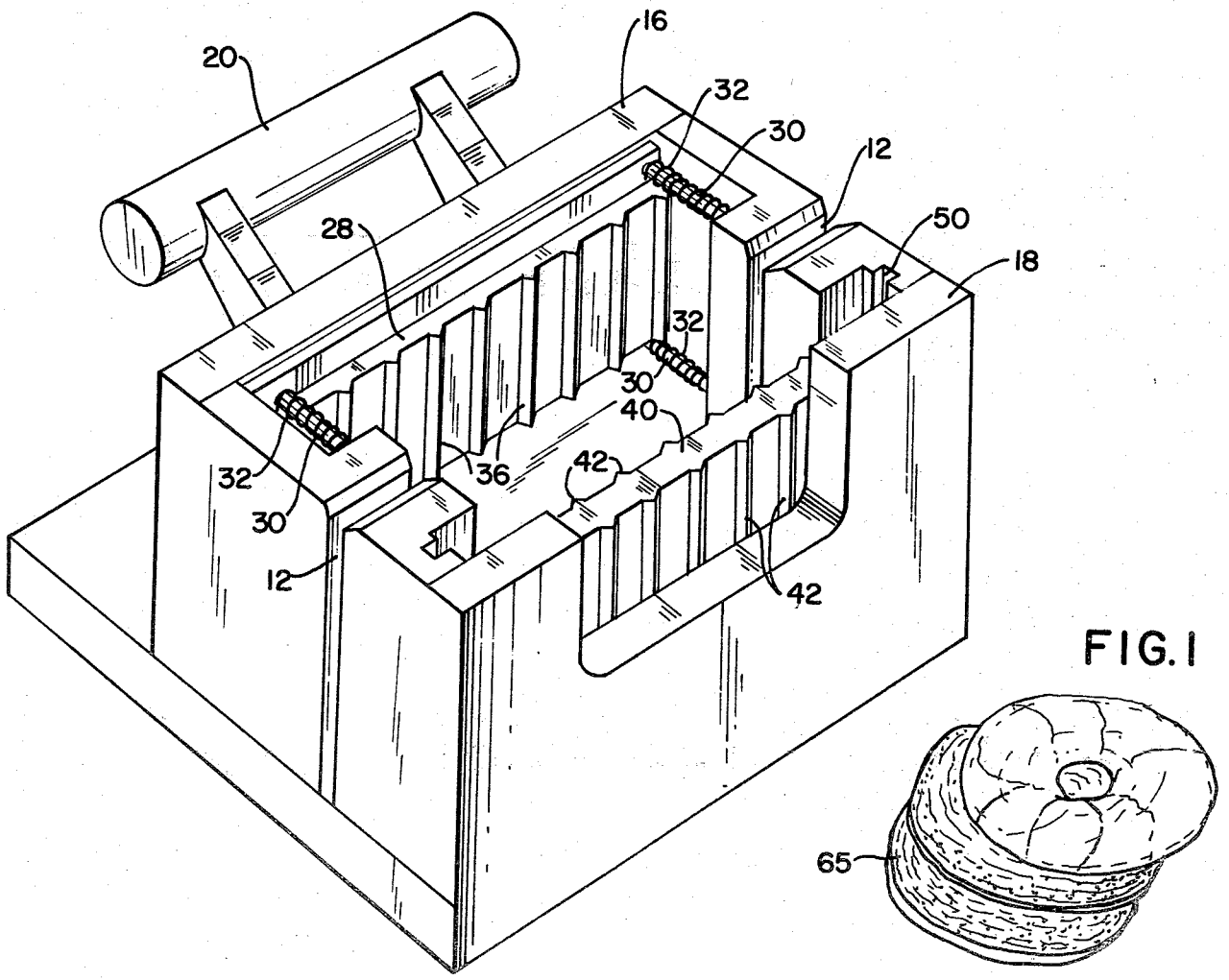
FIG. 1 is a perspective view of the safe grip slicer according to a preferred embodiment of the invention.
Figure 2:
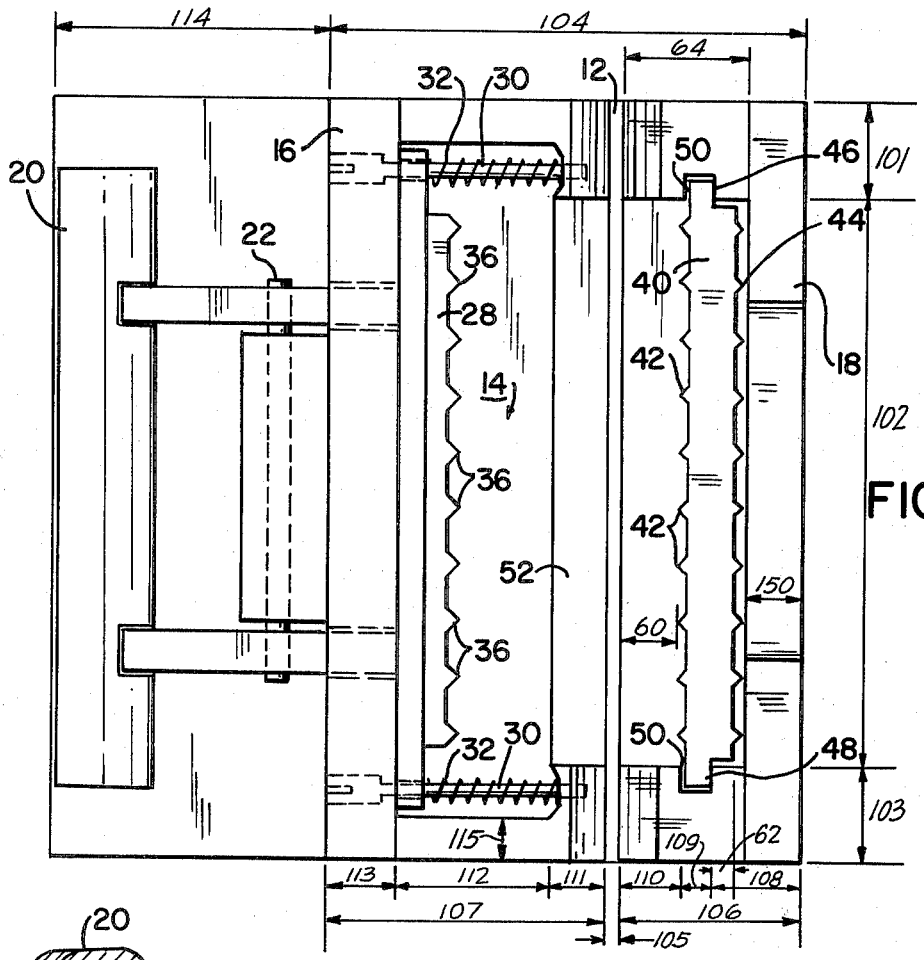
FIGS. 2 and 3 are top and end views, respectively of the slicer of FIG. 1.
Figure 3:
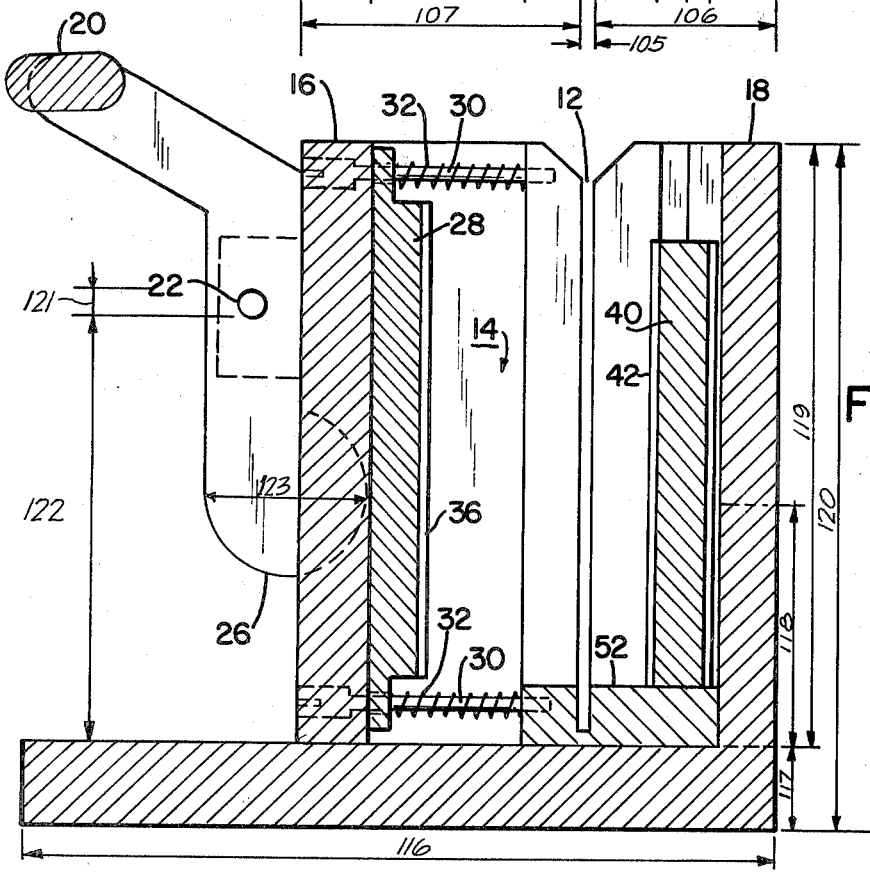

Referring to FIGS. 1–3, the safe grip slicer of the invention 10 is provided with a channel, or slot 12 for accepting a user inserted knife blade intended for the slicing of bagels, rolls, muffins, or the like, placed in a cavity 14 defined by a support frame 16, 18. As indicated, the slicer includes a handle 20 configured to pivot about a rod 22 and having a rounded bearing surface 26. More particularly, the portion 26 is arranged to bear against a lower portion of, and move, a floating, tension plate 28 inwardly of the cavity 14, from left-to-right as shown in the drawings. A pair of guide pins 30 are provided at opposing ends of the top and bottom portions of the tension plate 28, in guiding the tension plate into the cavity, against the resistance provided by coil or other type springing 32 which circumvent the guide pins 30. In a preferred embodiment of the invention, the apertures in the tension plate 28 through which the guide pins 30 protrude (35 in FIG. 6B) are of an area greater than the cross-section of the guide pins 30 in order to permit a floating action to be given to the tension plate 28—allowing it to tilt and twist, upwardly and to the left as in FIG. 3, as the handle 20 is moved downwardly and its bearing surface 26 rotated upwardly about the pivot rod 22. This is especially so should the various ribs, or treads 36 on the front surface thereof come in contact with irregular surfaces which are not parallel to the plane of the rib protrusions.

Also shown is a second, rigid plate 40, also provided with rib protrusions—42 on one side thereof and 44 on the opposing side, as more clearly shown in FIG. 2. In providing the rigidity to this plate 40, its ends 46, 48 are arranged to fit within a pair of acceptance slots 50 formed within the support frame 18. As will be appreciated, this plate 40 is essentially reversibly offset in that it can be removed from being held within the slots 50, and oriented such that either the rib protrusions 42, or the protrusions 44 extend in the direction of the rib protrusions 36 of the floating plate 28.

In accordance with the invention, when it is desired to slice a bagel, roll, muffin, etc., the item to be sliced is inserted into the cavity 14 with its flat-most surface aligned away from the handle 20—that is, towards the right side illustrated in FIGS. 1–3. The handle 20 is then grasped, and moved downwardly such that the rounded end 26 moves the tension plate 28 towards the right, as shown, until it bears against the opposing side of the bagel, etc., thereby holding it in place, and in a manner whereby the plate 28 is permitted to tilt or twist depending upon the configuration of such near side relative to the flat-most side of the item intended to be sliced. While holding the handle with one hand so as to hold the bagel, roll, or muffin in place, the consumer can then grasp the handle of a knife (not shown) and insert its cutting blade through the channel 12 to effect the slicing action. A stop surface 52 is included (FIG. 3) on which the bagel, etc. resides, such that when the channel 12 extends beyond the surface, the bringing of the knife blade to the lower most portion of the channel 12 ensures that the bagel, etc. has been sliced clear through.

Referring to FIG. 2 in particular, it will be seen that with the plate 40 positioned as shown, a slice section will result having a thickness denoted by the reference notation 60. By making the plate 40 removable and reversible, on the other hand, it is possible to produce, instead, a slice section of a thickness narrower by the dimensional notation 62, merely by reversing the orientation of the plate 40, assuming the rib protrusions 42 and 44 to be equal in breadth. Removing the plate 40 entirely, on the other hand, will result in a slice thickness represented by the dimensional notation 64. In each instance of thickness, however, the handle 20, when rotated downwardly, continues to hold the bagel, roll, muffin, etc. substantially fast in place, and, more importantly, with the hands being held away from the cutting proximity by the support frame 16.

As will be readily appreciated by one skilled in the art, not only does the slicer of FIGS. 1–3 serve to protect the hand from accidental cutting, and, with the mechanical advantage provided permitting one of weakened hand strength to slice the bagel, etc. also with sureness, the fixture will be seen to permit the slicing of several sections of the bagel, roll, muffin in serial fashion. For example, a cut may be made with the plate 40 entirely removed, then the plate can be re-inserted in the slots 50 in the direction illustrated in FIG. 2 to accept a second slice in that one-half section (the leftmost section of the bagel, etc. being first removed, and the resultant section slice cut once more by moving the handle 20 downwardly so as to bear the plate 28 against the slice section but with the plate 40 reversed in orientation such that the ribs 44 would extend inwardly of the cavity. With this arrangement, the end result will be seen to be an enabling of double-decker and triple-decker bagel, roll and muffin sandwiches, if desired, as well as a controlled slice thickness to enable an easy toasting of the bagel portions without the annoyance of having the slice caught within the confines of the toaster pop-up openings.

While applicant does not wish to be limited to any particular set of dimensions, the following have proven useful in one construction of the embodiment of FIGS. 1–3:

Dimension 101—$\frac{7}{8}$ inch
Dimension 102—5 inch
Dimension 103—$\frac{7}{8}$ inch
Dimension 104—4 5/16 inch
Dimension 105—$\frac{5}{8}$ inch
Dimension 106—1 11/16 inch
Dimension 107—$2\frac{1}{2}$ inch
Dimension 108—25/32 inch
Dimension 109—9/32 inch
Dimension 110—$\frac{5}{8}$ inch
Dimension 111—$\frac{1}{2}$ inch
Dimension 112—$1\frac{3}{8}$ inch
Dimension 113—$\frac{5}{8}$ inch
Dimension 114—2 7/16 inch
Dimension 115—$\frac{3}{8}$ inch
Dimension 116—$6\frac{3}{4}$ inch
Dimension 117—$\frac{3}{4}$ inch
Dimension 118—$2\frac{1}{8}$ inch
Dimension 119—$5\frac{3}{8}$ inch
Dimension 120—$6\frac{1}{8}$ inch
Dimension 121—$\frac{1}{4}$ inch
Dimension 122—$3\frac{3}{4}$ inch
Dimension 123—$1\frac{3}{8}$ inch The reversible plate 40, in one embodiment of the invention, was constructed with an overall length of 5 7/16 inches, a height of 4 inches and an overall thickness from protruding rib 42 to rib 44 of $\frac{1}{2}$ inches. In one such construction, the safe grip slicer 10 was fabricated of a wood-like material, although plastic compositions can be employed equally as well. Reference numeral 65 in FIG. 1 illustrates a bagel sliced into three sections employing the teachings of the invention, enabling a double-decker sandwich to be made.

Figure 4:
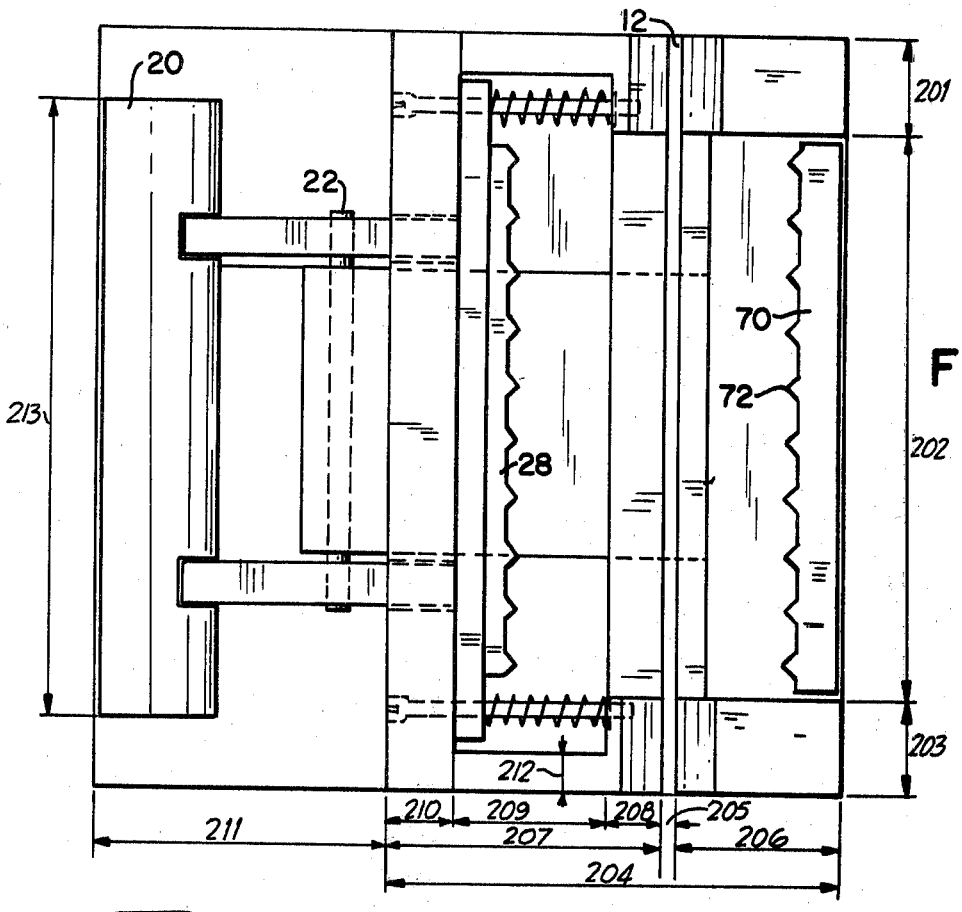
FIGS. 4 and 5 are top and end views of a second slicer constructed in accordance with the invention, which affords a continuous variation in the slice section thicknesses available.
Figure 5:
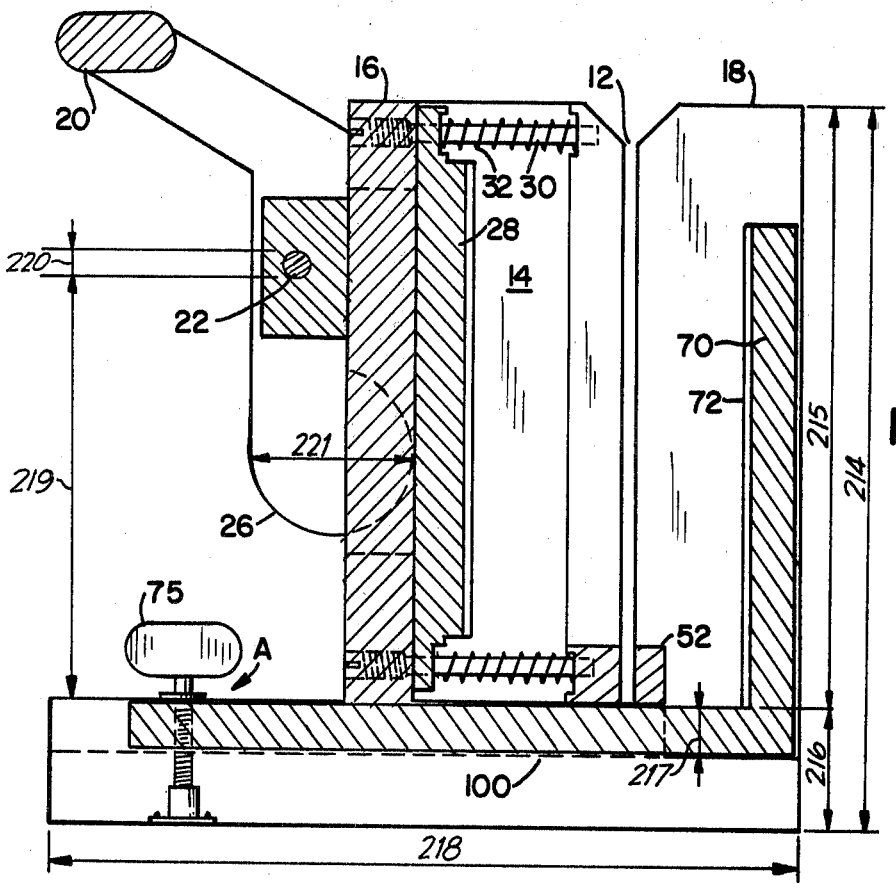

Referring, now, to the slicer of FIGS. 4 and 5, it will be understood that the second, rigid plate (here shown by the reference notation 70) is arranged to be continuously adjustable towards and away from the tension plate 28. In addition, the plate 70 has only a single set of protruding ribs, 72, and is not constructed to be removable from the support frame. As indicated in FIG. 5, the plate 70 is configured to have a slot at its left-most end A through which a knurled knob and bolt arrangement 75 is arranged to pass. With this configuration, all that is necessary to adjust the thickness of the slice taken is to loosen the knob arrangement 75 and then move the plate 70 either to the left or right as shown in FIG. 5 until the desired thickness is determined, at which time the knob 75 can be tightened, as by a simple rotation. To this end—and although not shown as such—the leftmost end A of the plate 70 can be provided with a grade reticule to indicate the resultant thickness which follows by any given placement of the plate 70 with respect to the channel or slot 12. Thus, a slice might be made of a bagel, roll, muffin, and the like with the positioning shown in FIG. 5, and then either the left section slice or right section slice inserted in the cavity 14, and adjustment of the plate 70 being made so as to slide such plate to the left, as shown in the drawing, and a second slice taken of a different thickness. With this arrangement, analysis has shown that slices as thin as $\frac{1}{8}$ inches can be obtained once the handle 20 is moved downwardly to actuate the tension plate 28 and the knife blade inserted through the slot 12 so as to cut the bagel, etc. section then being held in place. Although a more costly arrangement than that of FIGS. 1–3 to manufacture, the advantage to the slicer construction of FIGS. 4 and 5 are the many different thickness cuts which can be made, as compared to only the three thicknesses possible with the FIGS. 1–3 embodiment.

While applicant does not wish to be limited to any particular set of dimensions, the following have also proven useful in constructing the embodiment of FIGS. 4–5:

Dimension 201—$\frac{7}{8}$ inch
Dimension 202—5 inch
Dimension 203—$\frac{7}{8}$ inch
Dimension 204—$4\frac{1}{8}$ inch
Dimension 205—$\frac{1}{8}$ inch
Dimension 206—$1\frac{1}{2}$ inch
Dimension 207—$2\frac{1}{2}$ inch
Dimension 208—$\frac{1}{2}$ inch
Dimension 209—$1\frac{3}{8}$ inch
Dimension 210—$\frac{5}{8}$ inch
Dimension 211—$2\frac{5}{8}$ inch
Dimension 212—$\frac{3}{8}$ inch
Dimension 213—$5\frac{1}{2}$ inch
Dimension 214—$6\frac{1}{2}$ inch
Dimension 215—$5\frac{3}{8}$ inch
Dimension 216—$1\frac{1}{8}$ inch
Dimension 217—$\frac{1}{2}$ inch
Dimension 218—$6\frac{3}{4}$ inch Dimension 219—$3\frac{3}{4}$ inch
Dimension 220—$\frac{1}{4}$ inch
Dimension 221—$1\frac{3}{8}$ inch The plate 70 in this embodiment of the invention was constructed of an overall length of $4\frac{7}{8}$ inches, a height of $4\frac{3}{4}$ inches and an overall thickness of some $\frac{1}{2}$ inch.

Figure 6A:
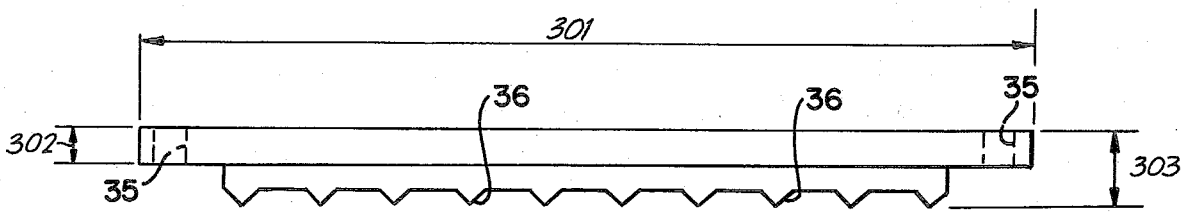
FIGS. 6A, 6B and 6C are top, front and side views respectively of the floating plate employed in holding the bagel, roll, muffin, or the like, in place in either slicer construction.
Figure 6B:
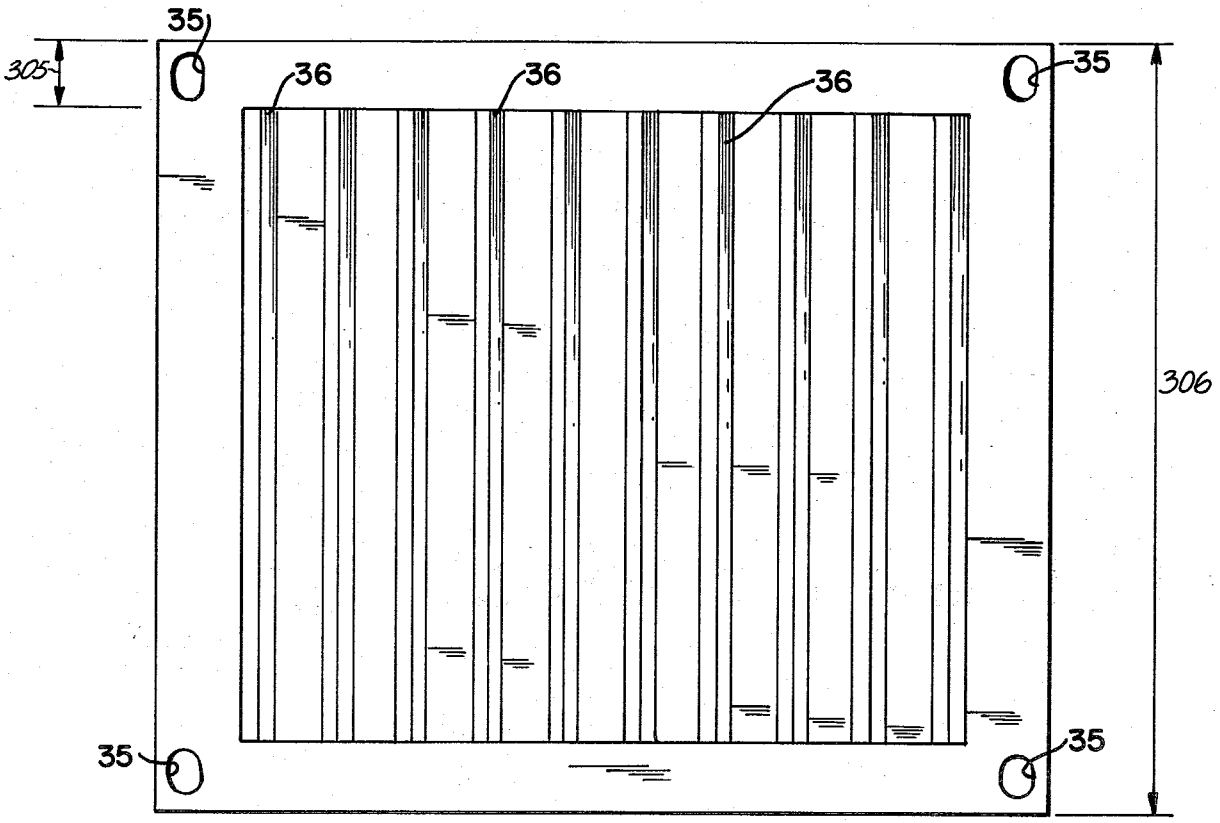
Figure 6C:
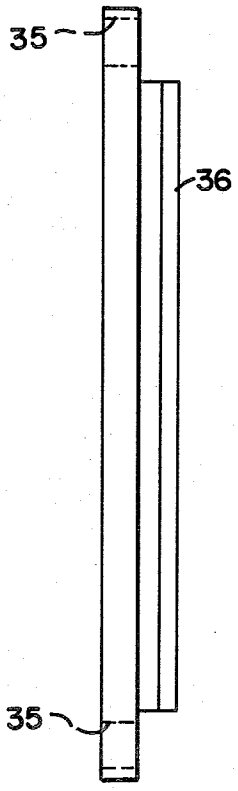

The tension plate illustrated in FIGS. 6A–6C is shown as having ten protruding ribs 36, for purposes of illustration which bear against the bagel, roll, muffin and the like, in holding it against the rigid plate (40 or 70) when holding the item in placed for subsequent slicing.

The following dimensions have proved useful:

Dimension 301—$5\frac{7}{8}$ inch
Dimension 302—$\frac{1}{4}$ inch
Dimension 303—$\frac{1}{2}$ inch
Dimension 304—9/16 inch
Dimension 305—9/16 inch
Dimension 306—$5\frac{1}{4}$ inch While there have been described what are considered to be preferred embodimeents of the present invention, it will be readily appreciated by those skilled in the art that modifications can be made without departing from the scope of the teachings herein. Thus, while the present invention has been described in the context of the safe slicing of bagels, rolls, muffins, and the like, it will be understood that other such items may be sliced in accordance with the teachings herein—such as small breads, apples, cheeses, etc. Although such cuttings do not provide the double-decker or triple-decker features possible with sandwich constructions when bagels, rolls, muffins, for example, are sliced, these other items can still be cut according to the invention in a manner offering simplicity and a high degree of safety through the use of one hand to hold the slicer handle downward and the other hand in operating the cutting knife blade. For at least such reason, therefore, resort should be had to the claims appended hereto for a correct understanding of the scope of the slicing apparatus of the invention.

I claim:

1. Slicing apparatus comprising:

a handle;

a frame providing a cavity for accepting an item to be sliced therein, and having a support rod around which said handle is arranged to pivot when in use;

a first, stationary plate within said frame for receiving one surface of the item to be sliced;

a pair of horizontally aligned guide means within said frame, extending in a direction from said handle towards said item to be sliced;

a second plate apertured to receive said guide means at opposing locations thereon, and to be supported thereby in floating relationship with respect to said frame;

a rounded surface on said handle, adapted to bear against said second plate under user control, for manually actuating said second plate towards an opposite surface of said item to be sliced, and for actuating said second plate by an extent to cause said second plate to abut against said opposite surface and to hold said one surface of said item in place against said first stationary plate;

with said rounded surface on said handle being positioned to bear substantially only against a lower portion of said second plate when said handle is pivoted, in giving said second plate a rotational actuation about said rounded edge and on said guide means, in abutting against said opposite surface of said item to be slice; and means adaptable to receiving a cutting blade, also manually controlled by said user, for slicing said item at a location intermediate said opposite item surfaces when held in place by said cooperating action of said first and second plates.

2. The apparatus of claim 1 wherein said first plate is of a pair of reversible configurations, to present one of two longitudinal dimensions measured from said first plate to the location of said cutting blade receiving means, the precise dimension presented being dependent upon the orientation of said first plate within said support frame.

3. The apparatus of claim 1 wherein there is additionally included means for adjustably positioning the location of said first plate within said support frame, in predetermined selecting the extent of actuation of said second plate needed to hold said one surface of said item to be sliced substantially in placed against said first plate.

4. The apparatus of claim 1 wherein said horizontally aligned guide means also include a compressible spring for returning said second plate to its original floating position upon the termination of user control, in releasing said handle.

5. The apparatus of claim 4 wherein said handle is rotatable downwards under user control to upwardly rotate said rounded surface against the lower portion of said second plate in actuating the movement of said second plate.

6. The apparatus of claim 4 wherein at least one of said first and second plates are provided with protrusion means on a surface thereof adjacent said one and said opposite item surfaces, respectively, for assiting in the holding of said item in place for subsequent slicing.

7. Slicing apparatus comprising:

a base;

first and second sections aligned on said base providing a cavity for accepting an item to be sliced therein, and spaced one from anotheer to form a slot to receive a cutting blade for the slicing of said item;

a pair of horizontally extending rods in said first section;

a first plate supported by said rods in floating relationship with respect to said first section;

a handle having a grasping surface and a rounded opposing surface adjacent a lower portion of said first plate;

a second plate forming a part of said second section;

and a pivot, responsive to user control, for rotating downwardly said handle grasping surface and for rotating upwardly said rounded opposing surface against said lower portion of said first plate, in actuating said first plate towards said cutting blade slot.

8. The apparatus of claim 7 wherein said second plate is removably insertable into said second support section.

9. The apparatus of claim 7 wherein said second plate forms a portion of said second support section.

* * * * *